US005301643A

United States Patent [19]

Garcyalny

[11] Patent Number: 5,301,643

[45] Date of Patent: Apr. 12, 1994

[54] LOW OIL SENSOR USING COMPRESSION RELEASE TO AFFECT ENGINE OPERATION

[75] Inventor: Gary J. Garcyalny, Milwaukee, Wis.

[73] Assignee: Briggs & Stratton Corporation, Wauwatosa, Wis.

[21] Appl. No.: 57,673

[22] Filed: May 5, 1993

[51] Int. Cl.[5] ..... F02B 77/00

[52] U.S. Cl. ..... 123/198 D

[58] Field of Search ..... 123/198 D, 182.1

[56] References Cited

U.S. PATENT DOCUMENTS

| | | | |
|---|---|---|---|
| 1,579,241 | 4/1926 | Papshvili . | |
| 2,259,047 | 10/1941 | Scott, Jr. . | |
| 2,499,319 | 2/1950 | Lillquist . | |
| 3,362,390 | 1/1968 | Esty . | |
| 3,496,922 | 2/1970 | Campen . | |
| 4,102,316 | 7/1978 | Valbert . | |
| 4,450,801 | 5/1984 | Thedens et al. . | |
| 4,453,507 | 6/1984 | Braun et al. . | |
| 4,522,170 | 6/1985 | Lenk et al. . | |
| 4,562,801 | 1/1986 | Koike . | |
| 4,898,133 | 2/1990 | Bader . | |
| 5,150,674 | 9/1992 | Gracyalny | 123/182.1 |
| 5,197,422 | 3/1993 | Oleksy et al. | 123/182.1 |

*Primary Examiner*—Noah P. Kamen

*Attorney, Agent, or Firm*—Andrus, Sceales, Starke & Sawall

[57] ABSTRACT

The engine protection device affects the engine operation when a low oil level is sensed by releasing substantially all of the compression pressure in the combustion chamber to prevent engine starting, to stop a running engine, or to reduce engine speed. The engine protection device includes a paddle or float whose movement is responsive to the crankcase oil level, an arm connected to the paddle or float, and a pivotable, yoke-type mechanical compression release mechanism that pivots in response to the movement of the arm. The compression release yoke has a first cam member that engages a valve tappet surface. When a low oil level is sensed, the paddle or float pivots the arm and the first compression release member, causing the first cam member to engage the tappet surface to substantially open the intake or exhaust valve. The invention may include a second, easy start compression release member that partially releases the compression pressure to promote engine starting. The second compression release member may be integrally formed with the first compression release member, or it may be a separate member.

24 Claims, 10 Drawing Sheets

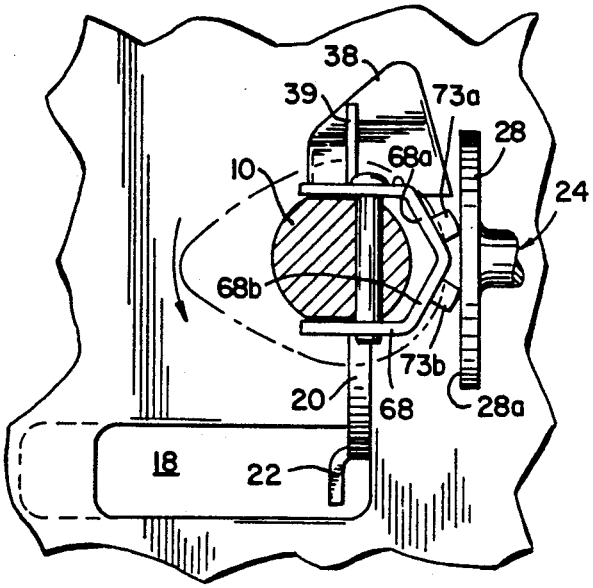
FIG. 9
FIG. 10
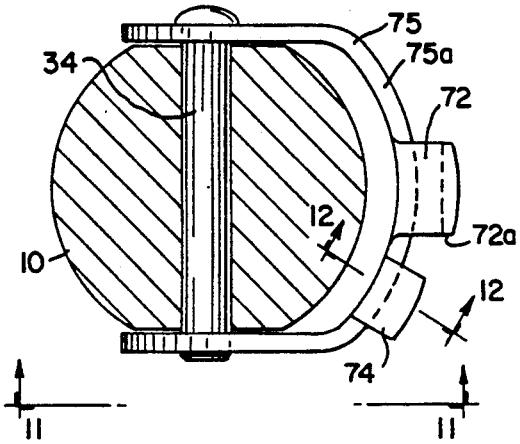
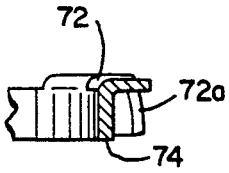
FIG. 12
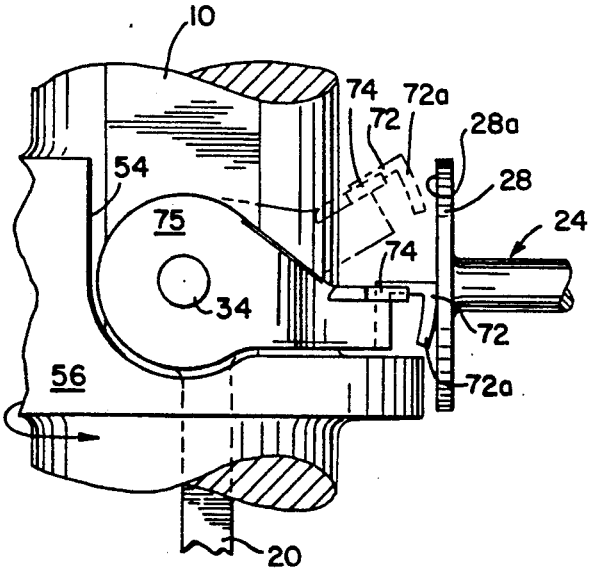
FIG. 11
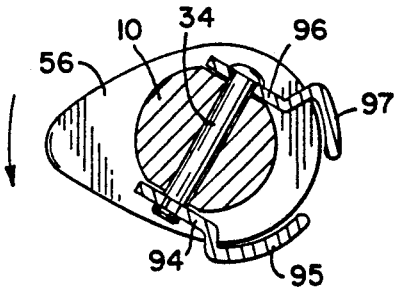
FIG. 23

FIG. 13
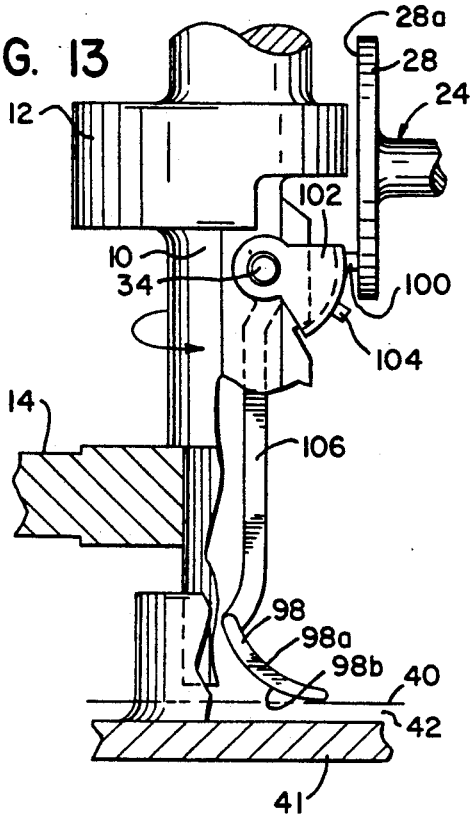
FIG. 14
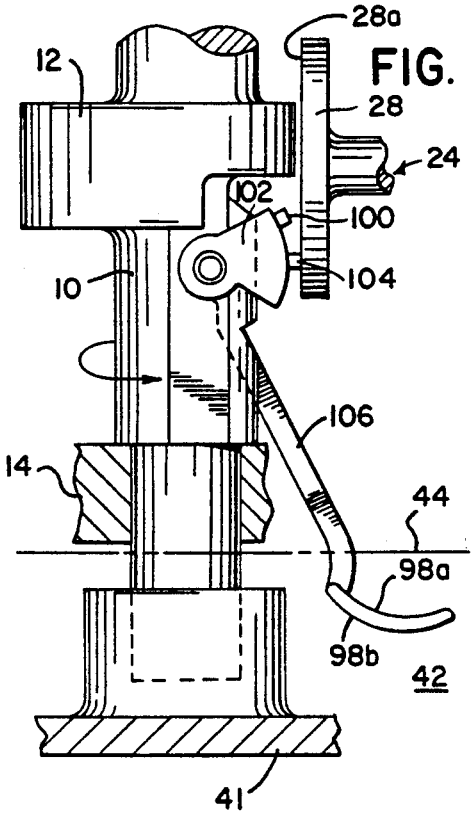
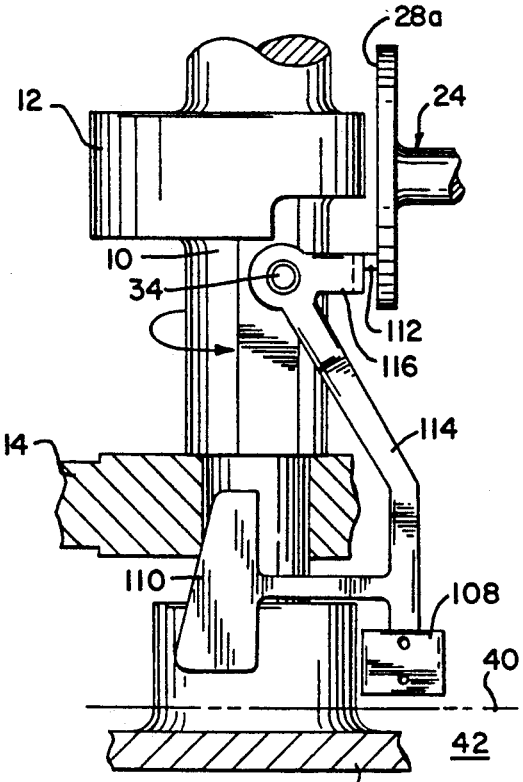
FIG. 15
FIG. 16
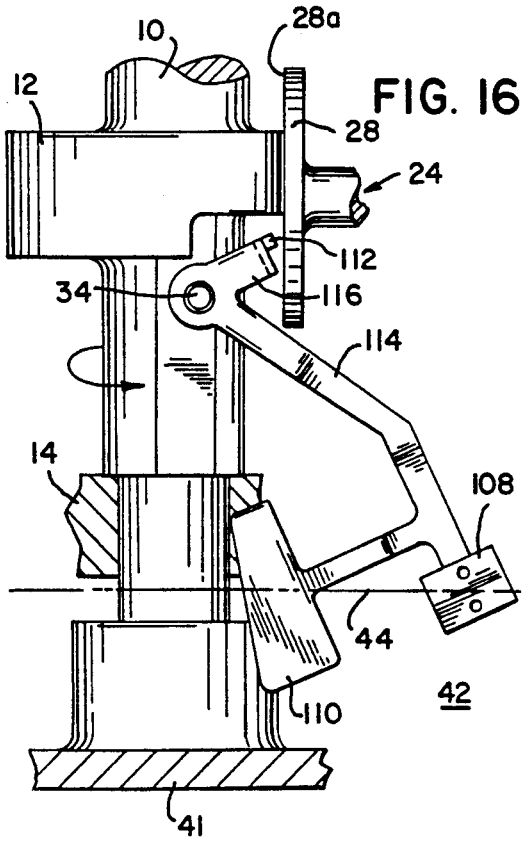

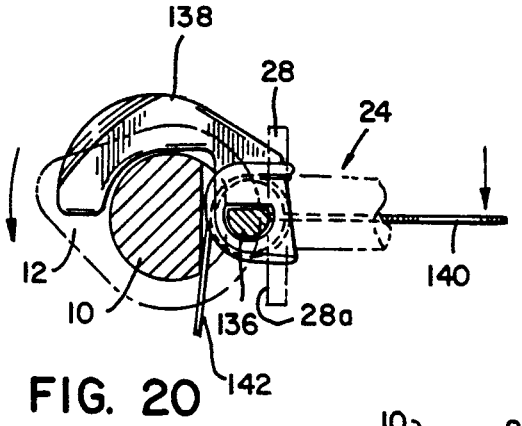
FIG. 20
FIG. 21
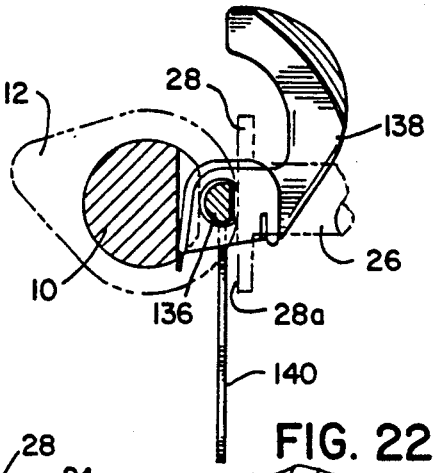
FIG. 22A
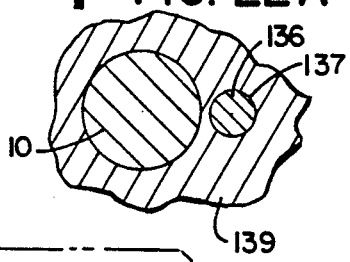
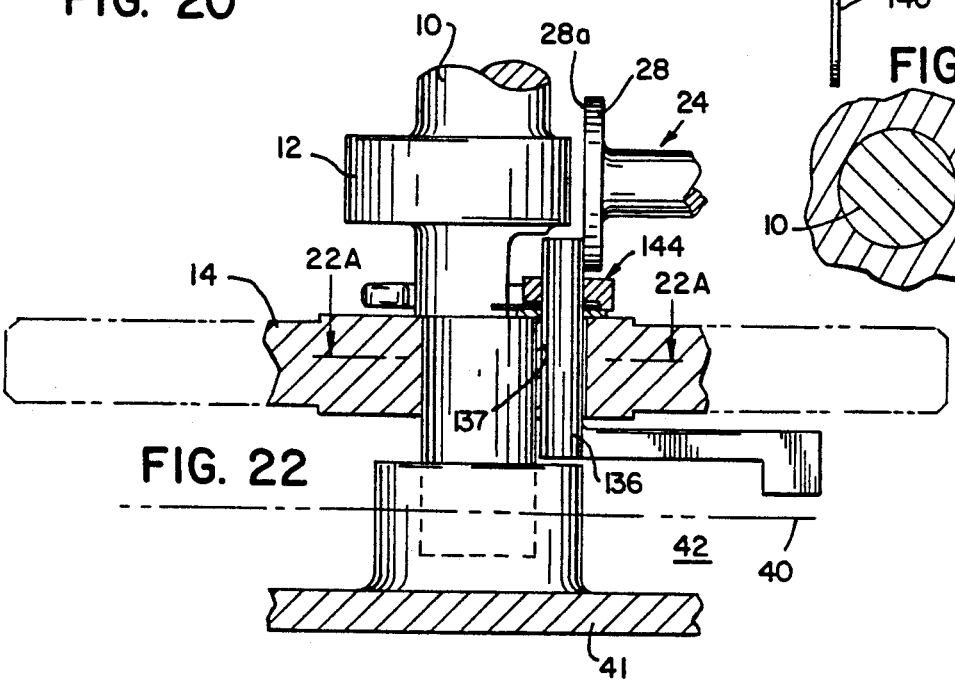
FIG. 22
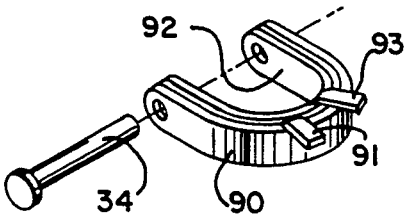
FIG. 24
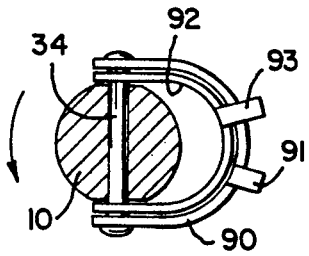
FIG. 25

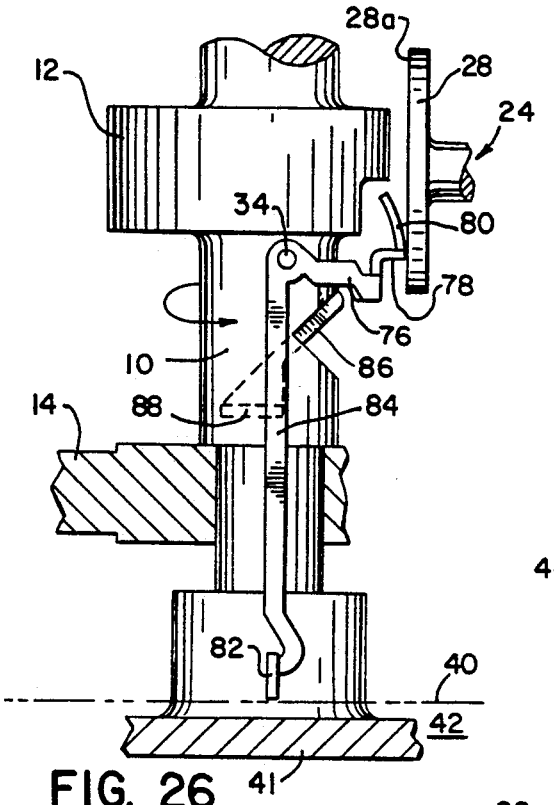
FIG. 26
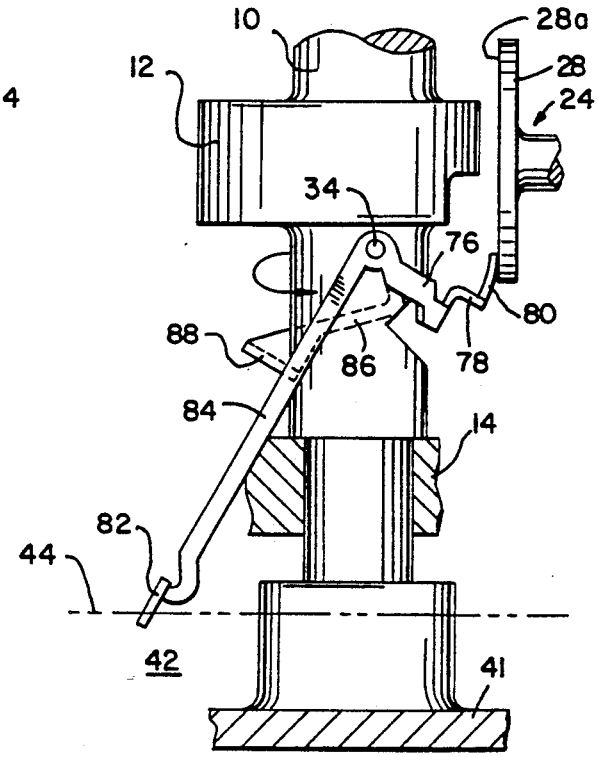
FIG. 27
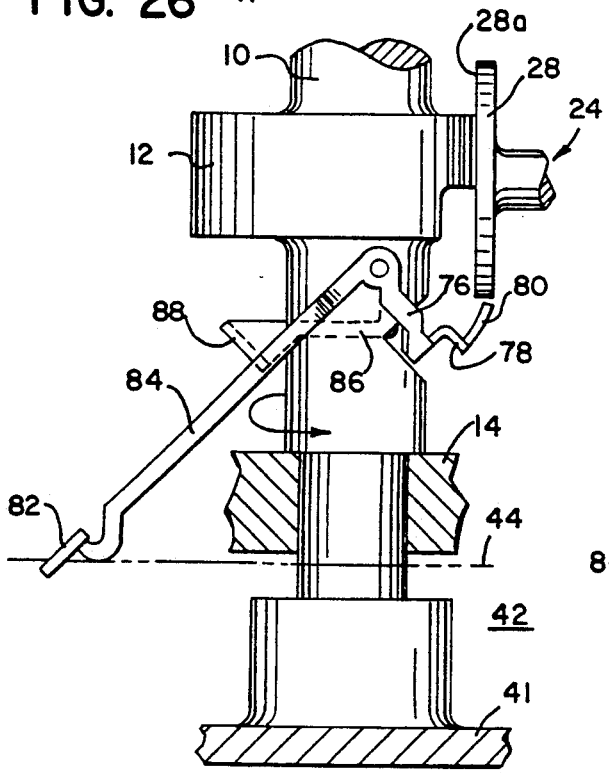
FIG. 28
FIG. 29
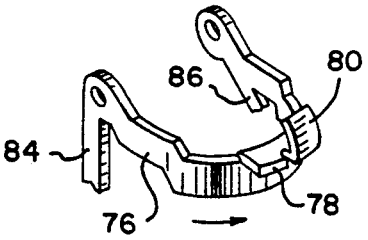

LOW OIL SENSOR USING COMPRESSION RELEASE TO AFFECT ENGINE OPERATION

BACKGROUND OF THE INVENTION

This invention relates to engine protection systems. More particularly, this invention relates to such systems which prevent the starting or operation of an engine when a low oil condition is sensed.

Many ways are known for stopping an internal combustion engine when a low oil level or low oil pressure is sensed during engine operation. Some of these devices cut off the fuel to stop the engine. See U.S. Pat. Nos. 2,259,047 issued Oct. 14, 1941 to Scott, Jr., and U.S. Pat. No. 4,102,316 issued Jul. 25, 1978 to Valbert. Other prior art devices interrupt engine ignition to shut off the engine when a low oil pressure condition is sensed. See U.S. Pat. No. 2,499,319 issued Feb. 8, 1950 to Lillquist.

These engine shut off devices typically require expensive valves or switches and additional wiring.

However, it is also desirable to prevent the engine from starting altogether to minimize engine damage if a low oil condition is sensed. Several techniques are known for preventing the starting of the engine under these circumstances. One typical prior art technique is to use a float, having an electrical contact, that floats in the engine crankcase oil. When the oil level becomes too low, the contact on the float makes an electrical connection with an electrical contact attached to the engine frame to ground the ignition pulses.

Such float-type oil level sensors are expensive since they contain several mechanical parts, additional wiring, and an electrical switch.

It is therefore desirable to provide a simple, inexpensive low oil sensor that prevents engine starting or engine operation when the oil level is below a predetermined level.

SUMMARY OF THE INVENTION

An engine protection system is disclosed that is simple, inexpensive, and preferably has only a single part.

In its broadest concept, the invention includes a low oil sensing means for sensing that the crankcase oil level is below a predetermined level, and a compression release means interconnected with the low oil sensing means for releasing the air/fuel mixture charge and compression pressure in the combustion chamber to prevent engine starting or to stop or slow a running engine when the sensed oil supply—either the oil volume or the oil level—is below the predetermined level.

The low oil sensing means and the compression release means are preferably integrally-formed from a single piece that is pivotally connected to an engine camshaft. The compression release means preferably includes a yoke-type mechanical compression release member having a cam member that engages a tappet surface of a valve operating means. The valve operating means substantially opens the intake or exhaust valve when the compression release means is in its engaged position. The compression release yoke is pivotally connected to the cam shaft by one or more pins that extend from the outer surface of the cam shaft. Although a yoke-type compression release member is preferred, any type of compression release means may be used.

The low oil sensor means preferably includes a lever arm having one end connected to the compression release member, and an opposite end interconnected with a paddle. The paddle has a surface that is designed to contact the crankcase oil. In alternate embodiments, the paddle is replaced by a float that slidably engages or is attached to an arm to move the arm in response to the oil level.

The preferred embodiment of the present invention operates in the following manner. When a low oil level is present at engine starting, the movable paddle or float does not make substantial contact with oil in the crankcase. As the cam shaft rotates, the lever arm remains in a position that is substantially parallel to the cam shaft axis of rotation, thereby holding the compression release member in its engaged position. In this position, the cam member engages the tappet surface to thereby substantially open the valve. Most or substantially all of the air/fuel mixture charge and compression pressure in the combustion chamber are released through the open valve; ignition and some combustion may still occur but the power output would be substantially diminished, thereby preventing engine starting, acceleration, or continued operation at normal engine running speeds.

When the paddle or the float encounters a significant amount of oil and resistance—indicating that the oil level is above the predetermined level—the lever arm is moved to thereby rotate the compression release member to a disengaged position. At this position, the cam member does not significantly contact the tappet surface, allowing compression pressure to build within the combustion chamber. Normal engine starting or operation is not affected.

The compression release means according to the present invention may be used with a second compression release means which only partially releases the compression pressure in the combustion chamber to improve engine startability. The second compression release means may include a second cam member interconnected with the first compression release member. In the alternative, the second compression release means may include a second compression release member that is pivotally connected with the cam shaft and that pivots independently from the first compression release member.

If two integrally-formed compression release means are used, the invention may also includes a retaining means for retaining the lever arm of the first compression release means in the proper position during engine starting. The retaining means preferably includes a centrifugally-responsive flyweight that provides a positive stop for the lever arm.

It is a feature and advantage of the present invention to provide a simple, inexpensive mechanical device that protects that engine from damage due to a low oil condition.

It is yet another feature and advantage of the present invention to use compression release to prevent an engine from starting or running when a low oil condition is sensed.

These and other features and advantages of the present invention will be apparent to those skilled in the art from the following description of the preferred embodiments and the drawings, in which:

BRIEF DESCRIPTION OF THE DRAWINGS

FIG. 9 is a top view, shown in partial section, of a third embodiment in which an extended cam member is split into two cam member portions to facilitate manufacturing.

FIG. 10 is an exploded top view of a fourth embodiment having first and second compression release cam members on a single yoke.

FIG. 11 is an exploded side view of the fourth embodiment, taken along line 11—11 of FIG. 10.

FIG. 12 is an exploded cross sectional view of the first and second cam members of the fourth embodiment along line 12—12 of FIG. 10.

FIG. 13 is a side view of a fifth embodiment of the present invention, depicted in the engaged or low oil position.

FIG. 14 is a side view of the fifth embodiment, depicted in the disengaged or adequate oil position.

FIG. 15 is a side view of a sixth embodiment having a fixed float, depicted in the engaged position.

FIG. 16 is a side view of the sixth embodiment, depicted in the disengaged position.

FIGS. 20 through 22 depict a ninth embodiment of the present invention using a D-shaped compression release member.

FIG. 20 is an exploded top view of the ninth embodiment depicted in the engaged position.

FIG. 21 is an exploded top view of the ninth embodiment, depicted in the disengaged position.

FIG. 22 is a side view of the ninth embodiment, depicted in the engaged position FIG. 22A is a top cross sectional view, taken along line 22A—22A of FIG. 22.

FIG. 23 is a top cross sectional view depicting an alternate way of pivotally connecting the first and second compression release members to the cam shaft at different pivot points.

FIGS. 24 and 25 depict an alternate arrangement for the first and second compression release members using two distinct, nested yoke members.

FIG. 24 is a perspective view depicting the manner in which the first and second nested yokes are pivotally connected to the cam shaft.

FIG. 25 is an exploded top view of the nested yoke assembly

FIGS. 26 through 29 depict a tenth embodiment of the present invention having first and second compression release cam members integrally formed into a single compression release yoke.

FIG. 26 is a side view of the tenth embodiment wherein the first compression release cam member is engaged to prevent engine operation due to a low oil condition.

FIG. 27 is a side view of the tenth embodiment wherein only the second compression release cam member is engaged to increase the startability of the engine.

FIG. 28 is a side view of the tenth embodiment wherein both the first and second compression release cam members are disengaged.

FIG. 29 is a perspective view of the yoke used in the tenth embodiment having integrally-formed first and second compression release cam members.

FIG. 30 is a top view depicting the lever arm in the low oil position.

FIG. 31 is a top view depicting the retaining of the lever arm in the adequate oil, easy start position wherein the first compression release cam member is disengaged and the second compression release cam member is engaged.

FIG. 32 is a top view depicting the lever arm in the engine running position wherein both the first and second compression release cam members are disengaged.

DETAILED DESCRIPTION OF THE PREFERRED EMBODIMENTS

Figure 1:
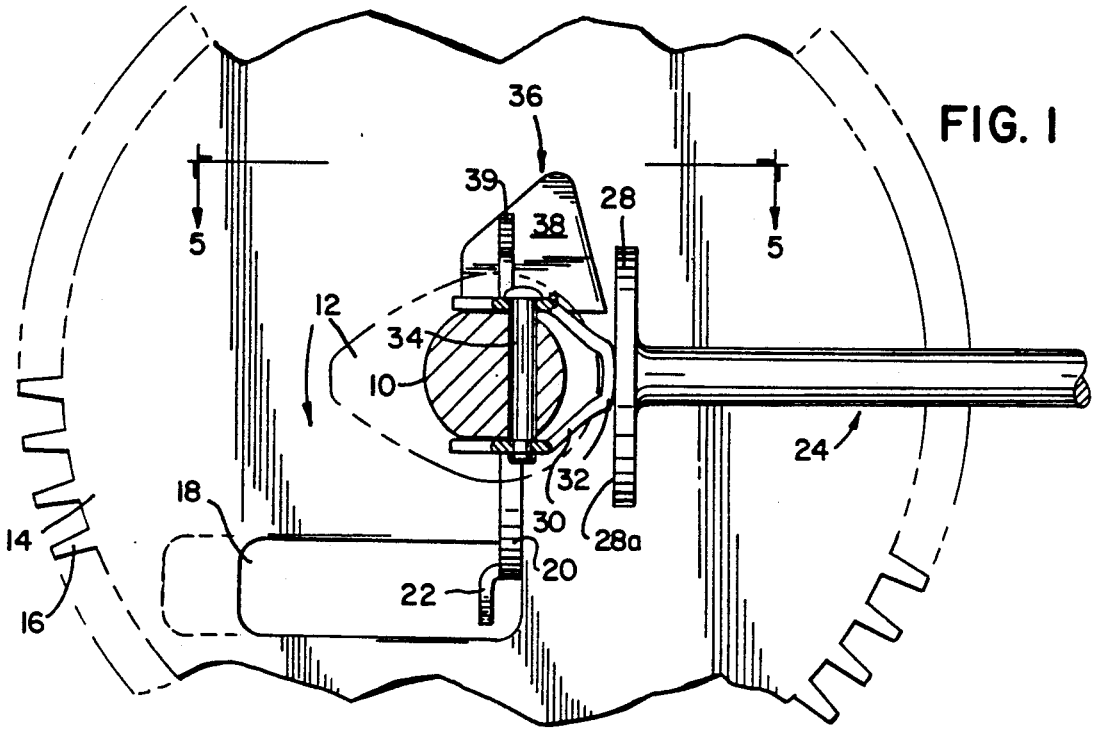
FIG. 1 is a top view of a first embodiment of the present invention, depicted in the low oil or no start position.
Figure 2:
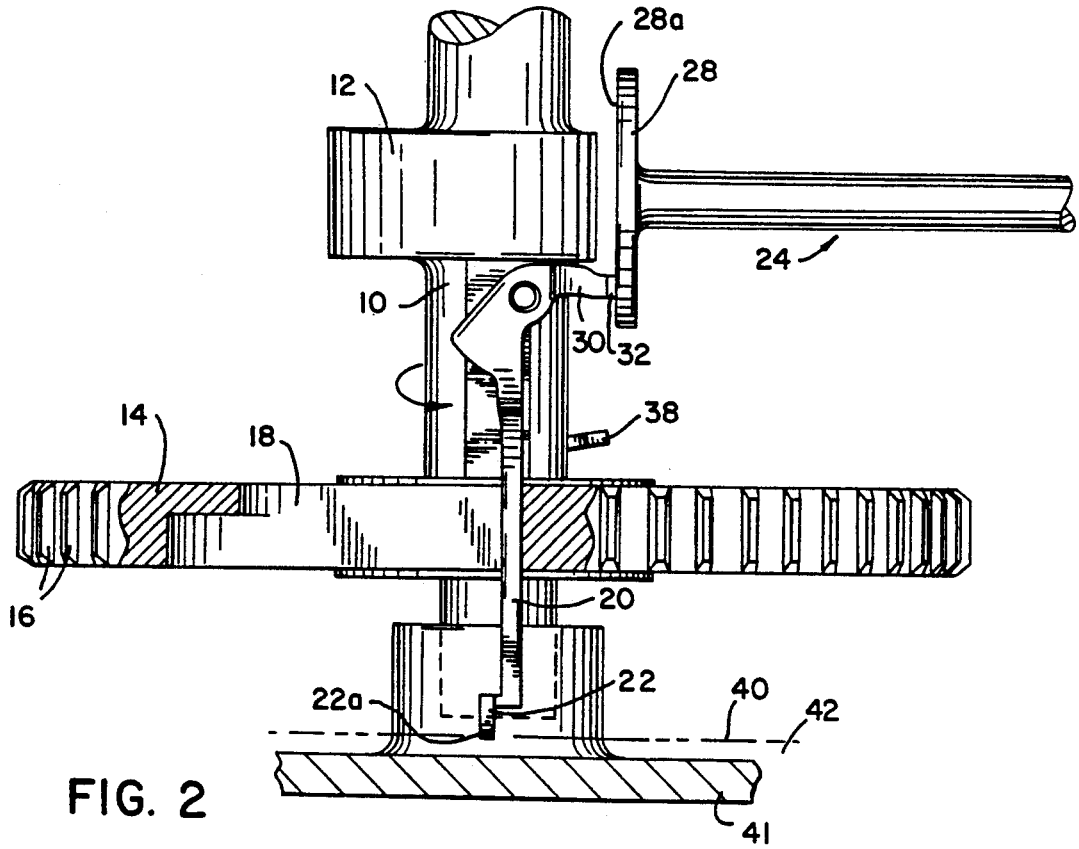
FIG. 2 is a side view of the first embodiment, depicted in the engaged or low oil position.

FIG. 1 is a top view of a first embodiment of the present invention depicted in the engaged or low oil position. FIG. 2 is a side view of the first embodiment, also depicted in the engaged position. In FIGS. 1 and 2, a cam shaft 10 and a cam lobe 12 formed integral therewith are rotated in a counterclockwise direction along with a cam gear 14. Cam gear 14 has teeth 16 thereon that are in meshing engagement with a timing gear (not shown) connected to the engine crankshaft (not shown). Cam gear 14 also has a slot or aperture 18 therein adapted to receive lever arm 20 and paddle 22 of the low oil sensor according to the present invention.

A valve operating means 24, including valve tappet 28, is interconnected with an intake valve or an exhaust valve (not shown) of an engine combustion chamber (not shown). When cam lobe 12 or mechanical compression release member 30 engage tappet surface 28*a* of tappet 28, valve operating means 24 will unseat the intake or exhaust valve from its valve seat, thereby releasing compression pressure in the engine combustion chamber. The intake valve and the exhaust valve control the flow of a gas either into or out of the combustion chamber, respectively.

The compression release means according to the present invention includes compression release member 30, a cam member 32 adapted to engage tappet surface 28*a*, and a means for pivotally connecting release member 30 to cam shaft 10. The pivotally connecting means preferably includes at least one shoulder pin 34 that extends from the outer surface of cam shaft 10 at opposite sides of the cam shaft to retain compression release member 30. A shoulder pin is preferred to prevent the yoke-shaped release member 30 from expanding due to the forces applied from valve operating means 24. Of course, other pin arrangements may be used, such as a pair of opposed, integrally-formed pin members protruding from the outer surface of cam shaft 10.

Pin 34 is preferably disposed so that it is not coplanar with the axis of rotation (the longitudinal axis of cam shaft 10), but lies in a line that is closer to cam member 32 than to cam lobe 12. The purpose of this arrangement is to insure that the center of mass distribution of the combined low oil sensor and compression release mechanism lies between pin 34 and the cam shaft axis of rotation, to insure that the gravitational force returns the sensor to the engaged position at rest, and that the effect of inertial and centrifugal forces on the mechanism will keep cam member 32 in the engaged position when a low oil condition exists. Other biasing means such as springs, or other mass distributions may be used to move the mechanism to the proper resting position.

The present invention, as depicted in FIGS. 1 and 2, also preferably includes a high oil level sensor 36 consisting of a counterweight 38 and a paddle 39. Counterweight 38 provides balance for the low oil sensor/compression release mechanism. The purpose of the high or overfull oil level sensor is to insure that cam member 32 engages tappet surface 28*a* when a high oil level condition exists, thereby substantially reducing or minimizing the compression pressure in the combustion chamber. A high oil level that is substantially above cam gear 14 is undesirable since a high oil level may increase oil burning, may hydraulically lock the engine, or may prevent the oil slinger from operating and lubricating properly.

Figure 3:
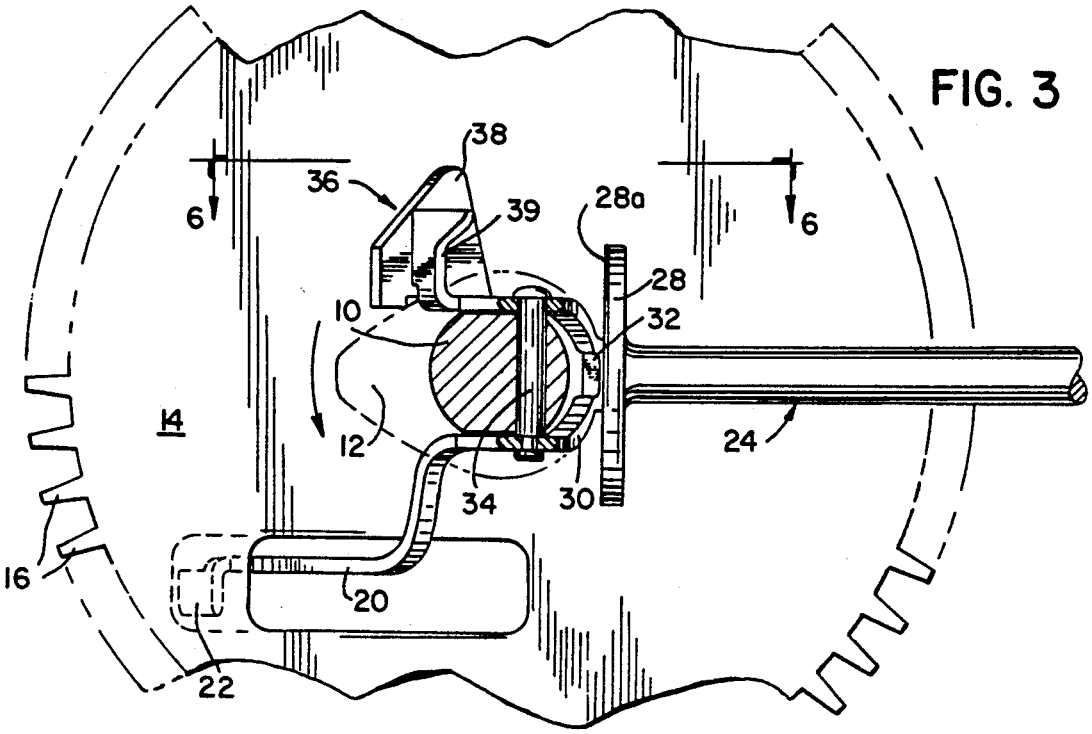
FIG. 3 is a top view of the first embodiment, depicted in the adequate oil or starting position.
Figure 4:
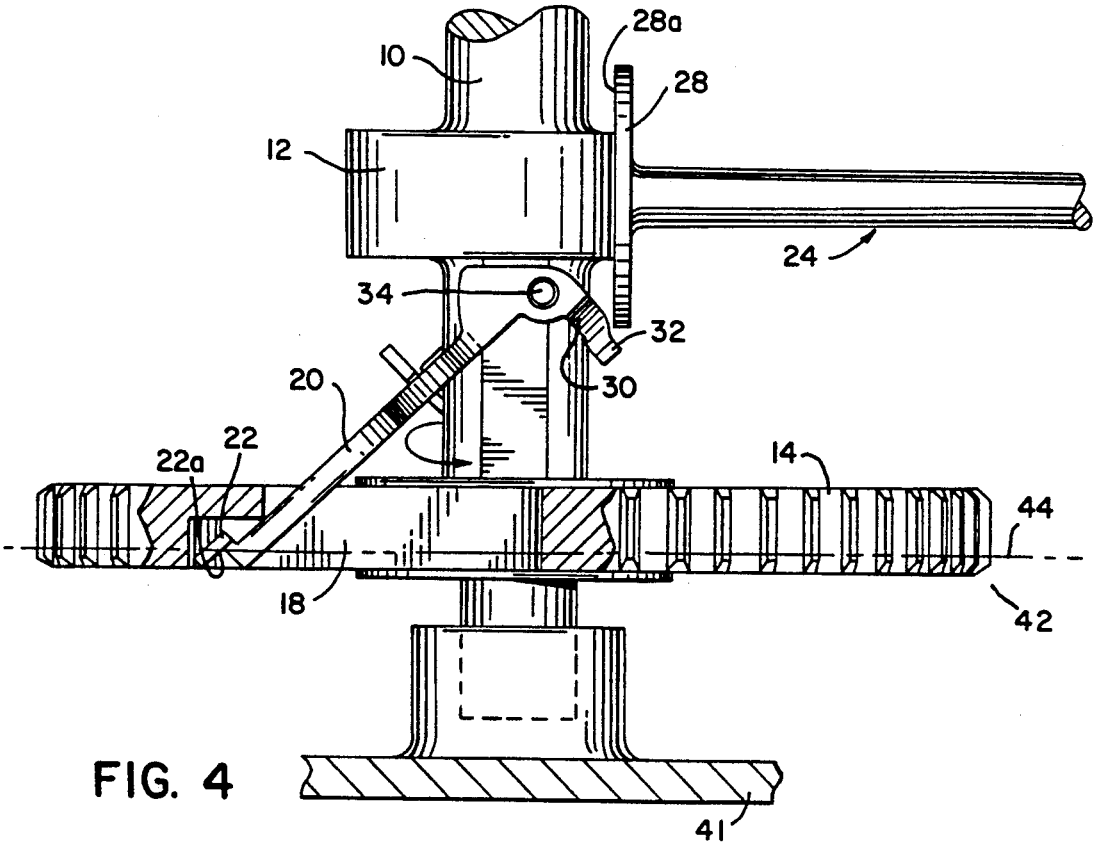
FIG. 4 is a side view of the first embodiment, depicted in the disengaged or adequate oil position.
Figure 5:
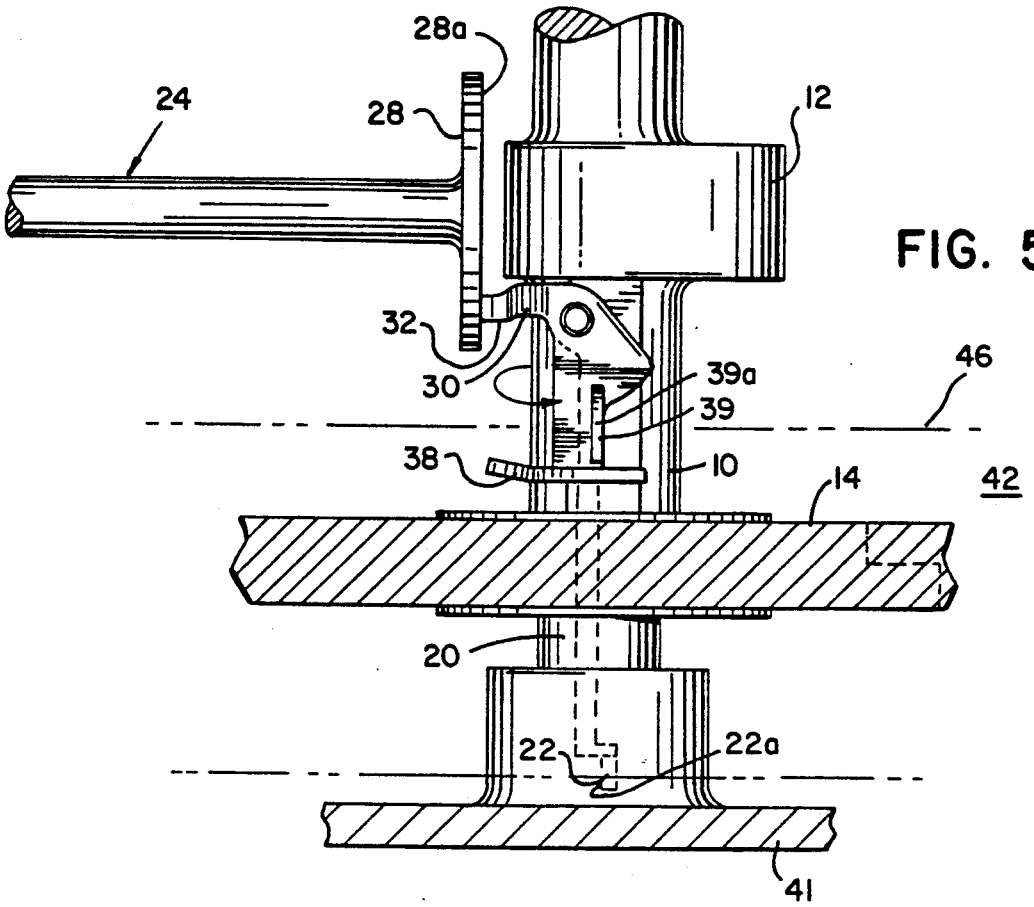
FIG. 5 is a side view of the first embodiment in the engaged position, taken along line 5—5 of FIG. 1.
Figure 6:
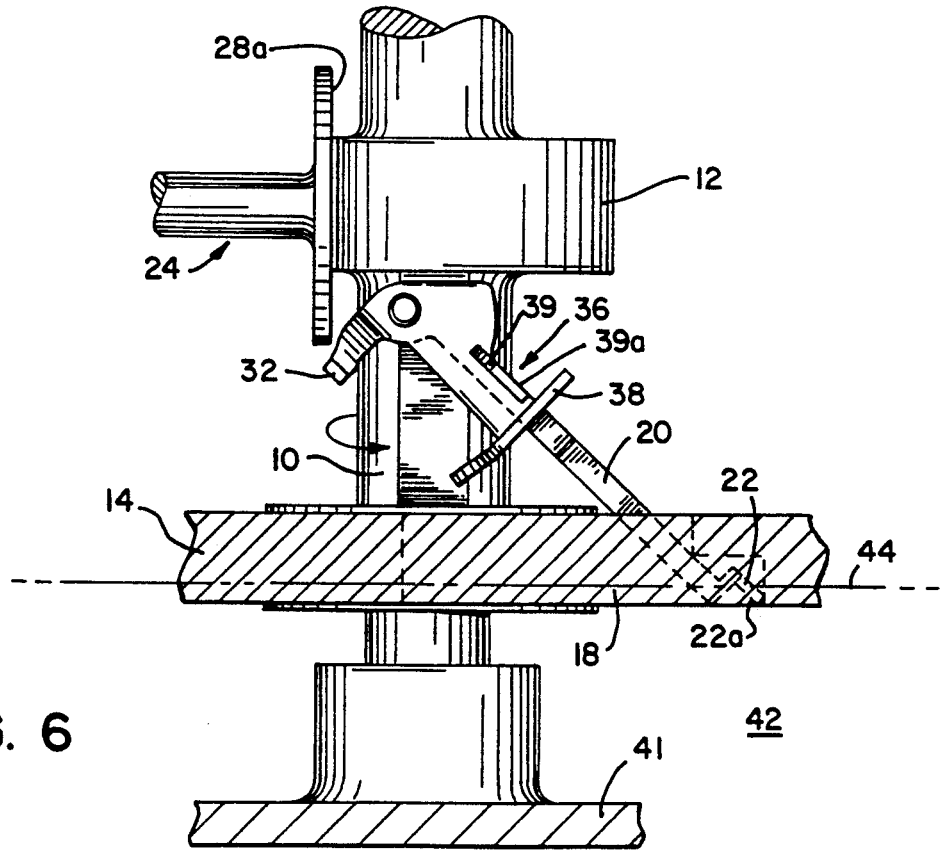
FIG. 6 is a side view of the first embodiment in the disengaged position, taken along line 6—6 of FIG. 3.

FIGS. 3 through 6 also depict the first embodiment of the present invention. FIGS. 3, 4 and 6 depict compression release member 30 and cam member 32 in the disengaged position due to the presence of adequate oil in crankcase 41. FIG. 5 depicts the first embodiment in the engaged position due to the presence of a high oil level. In FIGS. 1 through 6 as in all the Figures, components having corresponding functions have been given the same numerical designations.

The operation of the first embodiment will now be described in connection with FIGS. 1 through 6.

Referring specifically to FIGS. 1 and 2, oil level 40, as depicted in FIG. 2, is below paddle 22. Thus, oil 42 will not apply a significant resistive force to paddle surface 22*a* to move paddle 22. Paddle 22 is also opposed by the centrifugal force resulting from the rotation of cam shaft 10. As cam shaft 10 rotates in the counterclockwise direction, paddle 22 and lever arm 20 will tend to be forced in a direction toward cam shaft 10 until lever arm 20 is stopped substantially parallel to the cam shaft axis of rotation. This movement of lever arm 20 and paddle 22 will cause compression release member 30, interconnected with lever arm 20, and cam member 32 to pivot to the engaged position, so that cam member 32 contacts tappet surface 28*a* during the rotation of cam shaft 10. Compression release member 30 and cam member 32 are designed to substantially move tappet 28, thereby substantially opening the valve. If the valve is substantially open at engine starting speeds, the compression pressure in the combustion chamber is reduced to such a degree that engine starting will be prevented. If cam member 32 is engaged at engine running speeds, the loss of compression pressure will either cause the engine to stop or will reduce the engine power output and/or engine speed, depending upon the design of the compression release mechanism. The gravitational force will return the low oil sensor to the engaged position when the engine stops running.

FIGS. 3 and 4 depict the first embodiment of the present invention in the disengaged or safe oil position. Referring to FIGS. 3 and 4, oil level 44 of oil 42 is sufficiently high to prevent the low oil sensor from causing the compression release means to remain engaged. As cam shaft 10 rotates in the counterclockwise direction, oil 42 contacts surface 22*a* of paddle 22, thereby causing paddle 22 to move in a direction away from cam shaft 10. This movement of paddle 22 moves lever arm 20 in a similar direction, causing compression release member 30 to rotate in the clockwise direction about pivot pin 34. The clockwise rotation of release member 30 causes cam member 32 to move in a clockwise direction toward cam gear 14, thereby disengaging cam member 32 from tappet surface 28*a*. As a result, compression is not released in the combustion chamber, allowing the engine to start or to continue running at its typical running speed.

To enable cam member 32 to disengage from tappet surface 28*a* when adequate oil is present, the size of paddle surface 22*a*, the dimensions of lever arm 20, of compression release member 30, and of cam member 32, the location of the center of gravity, and the mass distribution of the combined low oil sensor/compression release mechanism are selected so that the force of oil 42 on paddle surface 22*a* is sufficient to overcome the inertial and centrifugal forces on the combined low oil sensor/ compression release mechanism.

FIGS. 5 and 6 depict the operation of the high oil sensor 36 according to the present invention. In FIG. 5, oil level 46 of oil 42 is substantially above cam gear 14 and contacts surface 39*a* of high oil paddle 39. Paddle 39 is located on the opposite side of cam shaft 10 from low oil paddle 22. When oil level 46 is sufficiently high so that oil 42 applies a sufficient force to surface 39*a*, compression release member 30 and cam member 32 are rotated to the engaged position despite the fact that oil 42 is also contacting surface 22*a* of low oil paddle 22. If oil level 46 is sufficiently high to reach high oil paddle 39, the oil resistive force on paddle surface 39*a* overcomes the oil resistive force on low oil paddle surface 22*a* in the opposite direction to keep cam member 32 engaged with tappet surface 28*a*.

FIG. 6 is a side cross sectional view of the first embodiment, taken along line 6—6 of FIG. 3. FIG. 6 depicts the position of high oil sensor 36 when oil level 44 is adequate but is not too high. In this situation, there is no oil resistance force on surface 39*a* of paddle 39. Paddle 22 is free to move in response to oil level 44 alone, causing lever arm 20 to rotate away from cam shaft 10, thereby disengaging cam member 32 from tappet surface 28*a*.

Figure 7:
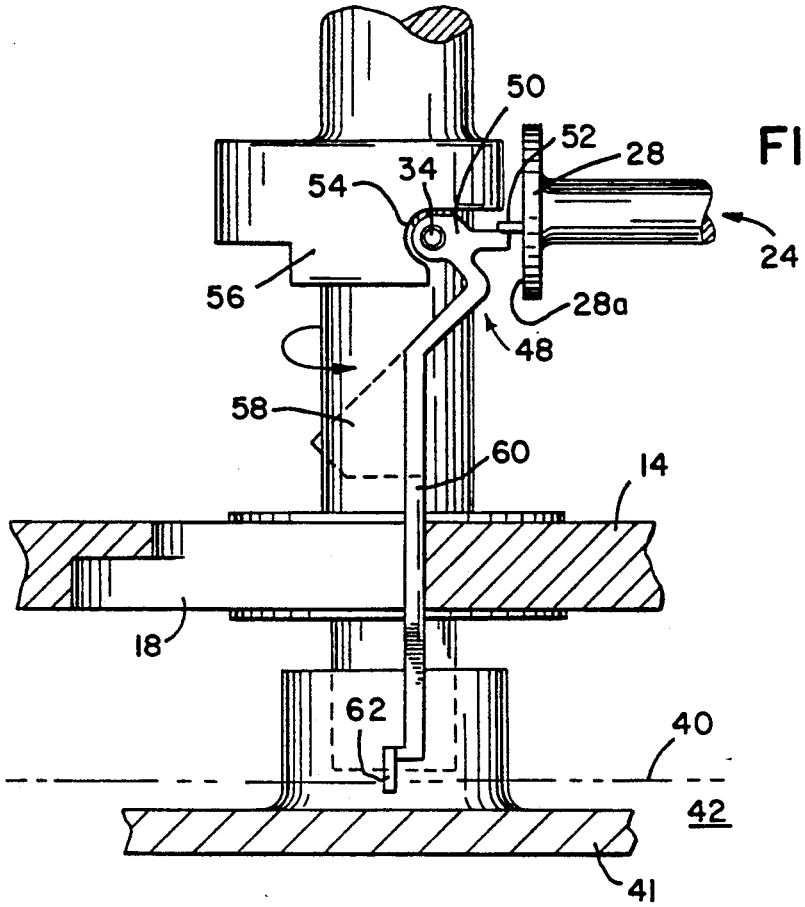
FIG. 7 is a side view of the second embodiment of the present invention, depicted in the engaged or low oil position.
Figure 8:
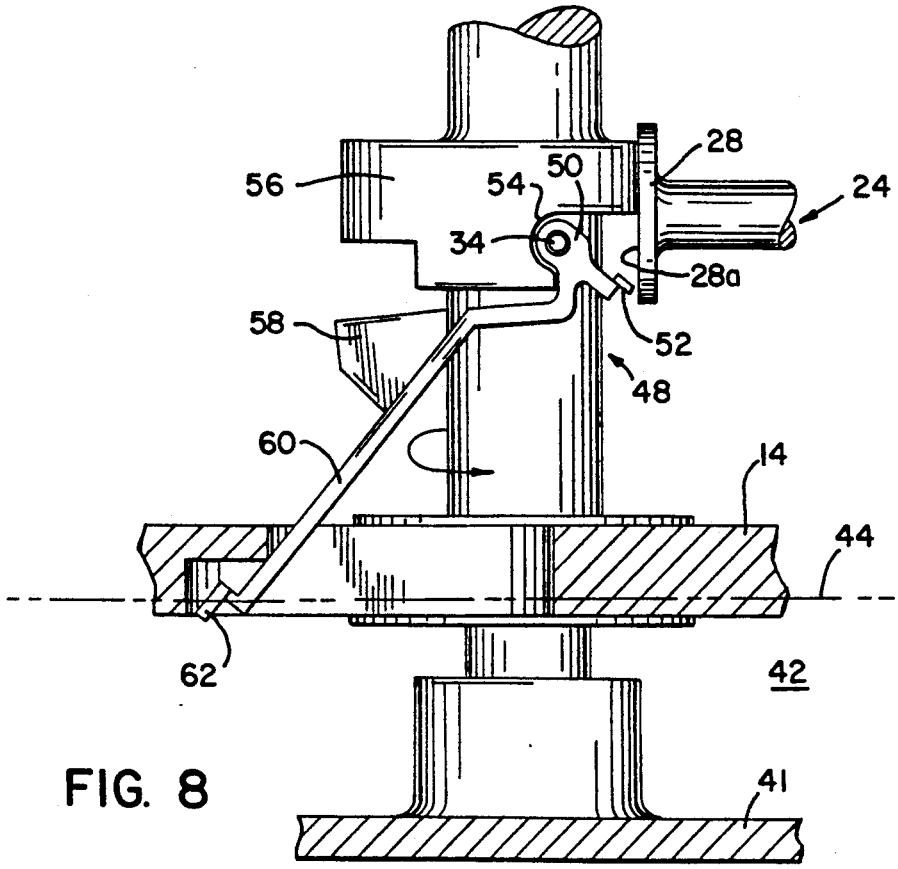
FIG. 8 is a side view of the second embodiment, depicted in the disengaged or adequate oil position.

FIGS. 7 and 8 are side views depicting a second embodiment of the present invention. FIG. 7 depicts the engaged or low oil position, whereas FIG. 8 depicts the disengaged or safe oil position.

In FIGS. 7 and 8, compression release means 48, including compression release member 50 and cam member 52, are similar to the compression release means discussed above in connection with the first embodiment. However, the forces imposed by tappet 28 are substantially borne by a shoulder 54, comprising a surface formed within cam 56. It may be desirable to transfer the loads imposed by tappet 28 to shoulder 54 instead of having them borne by pivot pin 34, as described in U.S. Pat. No. 5,150,674, issued Sept. 29, 1992, the specification of which is incorporated by reference herein.

To provide balance for the low oil sensor/ compression release means, a counterweight 58 is attached to compression release member 50 opposite to lever arm 60.

Paddle 62 in the second embodiment operates in a similar manner to paddle 22 in the first embodiment described above. The second embodiment depicted in FIGS. 7 and 8 operates in a very similar manner to the first embodiment as described above, so a description of the operation will not be repeated.

FIGS. 9 through 14 all depict another feature of the present invention, namely the use of a second compression release means to partially release the compression pressure in the combustion chamber during engine starting to improve startability of the engine. The second compression release means only partially releases the compression pressure, whereas the first compression release means discussed above substantially releases the compression pressure. Since it is desirable to use a yoke-type second compression release means to increase startability, it may be desirable to combine the first compression release means and the second compression release means to minimize cost and assembly time. Although the second compression release means depicted and described herein is a yoke-type compression release mechanism, it should be understood that other types of compression release means may be used, including a bump on the cam lobe, or a D-shaped compression release mechanism.

When both first and second mechanical compression release means are used, they may be combined into a single compression release device or they may be independent from each other. FIGS. 9 through 14 and FIGS. 26 through 29 depict first and second compression release means being integrally formed in a single yoke-type compression release mechanism. FIGS. 23 through 25 depict the first and second compression release means being formed from two independent, nested yoke-type compression release members.

FIG. 10 is an embodiment wherein the first and second compression release means are combined into a single mechanism. In FIG. 10, a first cam member 74 and a second cam member 72 are both formed integral with a single yoke-type compression release member 75. Cam members 74 and 72 both protrude from a substantially rounded portion 75*a* of compression release member 75. Second cam member 72 is the first of the cam members to engage tappet surface 28*a*, with first cam member 74 almost immediately thereafter engaging the tappet surface if a low oil condition is sensed. In effect, cam members 72 and 74 act as a single unit when a low oil condition is sensed since the valve does not have significant time to close after being partially unseated by second cam member 72.

As an alternative to the embodiment depicted in FIG. 10, cam members 72 and 74 may be formed as a single, extended cam member. Instead of forming cam members 72 and 74 as a single, extended cam member, the extended cam member may be split into two cam member portions 73*a* and 73*b* to facilitate manufacturing, as depicted in FIG. 9. The difficulty in bending an extended cam member would be eliminated. Cam member portion 73*a* is disposed on a flat section 68*a* of yoke 68. Cam member portion 73*b* is disposed on a flat section 68*b* of yoke 68. In FIG. 9, cam members 72 and 74 would engage and disengage simultaneously, not independently as depicted in FIGS. 23 through 25.

FIG. 11 is a side view of the compression release member of FIG. 10, taken along line 11—11 on FIG. 10. As depicted in FIG. 10, second cam member 72 extends substantially towards tappet surface 28*a* to substantially move tappet 28 when a low oil condition is sensed, as depicted in FIG. 11. Cam member 72 has a tab 72*a* that extends in an arc downward towards the cam gear, so that tab 72*a* still engages tappet surface 28*a* even if compression release member 75 is rotated upward to disengage first cam member 74 when an adequate oil condition exists.

First cam member 74 will remain engaged with tappet surface 28*a* only when a low oil condition exists The spatial relationships and positions of cam members 72 and 74 are further depicted in FIG. 12.

FIGS. 26 through 29 depict a slightly different arrangement for the first and second compression release means depicted in FIG. 9 and in FIGS. 10 through 12.

In FIGS. 26 through 29, a single yoke-type compression release member 76 has a first cam member 78 and a second cam member 80 formed integral with first cam member 78. The orientations of cam members 78 and 80 are best shown in FIG. 29.

As depicted in FIG. 26, first cam member 78 engages tappet surface 28*a* when paddle 82 is above oil level 40, indicating that a low oil condition exists. In that condition, lever arm 84 is substantially parallel to the axis of rotation.

When an adequate oil condition exists as depicted in FIG. 27, the oil resistance on paddle 82 rotates the paddle and lever arm 84, thereby causing compression release member 76 to pivot about pin 34 in a downward direction toward cam gear 14. First cam member 78 is disengaged from tappet surface 28*a*, although second cam member 80 remains engaged with tappet surface 28*a* to promote easier starting of the engine.

FIG. 28 depicts the embodiment of FIGS. 26 and 27 at engine running speeds when adequate oil exists. As shown in FIG. 28, both first cam member 78 and second cam member 80 are disengaged from tappet surface 28*a*, allowing full compression pressure to be achieved in the combustion chamber.

The embodiment depicted in FIGS. 26 through 29 includes a leg 86 connected to the opposite side of compression release member 76 from lever arm 84 to provide balance to the structure. Attached to the other end of leg 86 is a counterweight 88 that also provides balance to the structure and insures that the center of gravity of the combined low oil sensor/compression release means is in the proper location.

FIGS. 23 through 25 depict alternate embodiments of the present invention in which two independent first and second compression release means are used. FIGS. 24 and 25 depict the use of two nested yoke-type compression release members 90 and 92 being independently pivotable about a single pin 34. First compression release member 90 has a first cam member 91 extending therefrom. Second compression release member 92 has a second cam member 93 extending therefrom. It is apparent from the arrangement depicted in FIGS. 24 and 25 that whenever first cam member 91 is engaged, second cam member 93 will also be engaged since second cam member 93 rests on first compression release member 90. The engagement of both cam members 91 and 93 with tappet surface 28*a* prolongs the unseating of the valve, thereby further reducing the compression in the combustion chamber. When second cam member 91 disengages from tappet surface 28*a*, second cam member 93 will still engage tappet surface 28*a* at engine starting speeds, but will disengage at engine running speeds.

FIG. 23 depicts an alternate embodiment wherein two half-yoke compression release members 94 and 96 are used. First compression release member 94 has a cam member 95 connected thereto, whereas second compression release member 96 has a second cam member 97 formed integral therewith. Compression release members 94 and 96 are independently pivotable about a single pivot pin 34. As cam shaft 10 rotates in the counterclockwise direction at engine starting speeds, tappet surface 28*a* (FIG. 28) will first engage second cam member 97 and will thereafter engage first cam member 95 if a low oil condition exists.

FIGS. 13 and 14 depict an alternate embodiment of the present invention in which the low oil sensor includes an air-foil shaped paddle 98 instead of the substantially flat paddle described above in connection with the other embodiments. When oil level 40 is low as depicted in FIG. 13, first cam member 100 of a yoke-type compression release member 102 engages tappet surface 28*a*. The easy start, second cam member 104 is disengaged when a low oil condition exists.

When an adequate oil condition exists as depicted in FIG. 14, oil drag or resistance causes paddle 98 to move somewhat away from cam shaft 10, thereby rotating lever arm 106 away from the cam shaft. This movement of lever arm 106 causes first cam member 100 to disengage from tappet surface 28*a*. The pressure differential across surfaces 98*a* and 98*b* of paddle 98 creates an opposing force which holds second cam member 104 engaged with tappet surface 28*a*, thereby allowing the engine to start and operate normally.

FIGS. 15 and 16 depict another embodiment of the present invention using a fixed float 108 instead of a paddle in the low oil sensor. The embodiment of FIGS. 15 and 16 also includes a counterweight 110 which keeps first cam member 112 in the engaged position when float 108 is above low oil level 40. Without counterweight 110, centrifugal force acting on float 108 due to cam shaft rotation during a starting attempt would cause float 108 and lever arm 114 to move away from cam shaft 10, causing first compression release member 116 to move first cam member 112 to the disengaged position. This situation would permit the engine to start even with a low oil condition present.

FIG. 16 depicts the embodiment of FIG. 15 in the disengaged position, which occurs when float 108 is floating on an adequate oil level 44. Centrifugal forces act on the repositioned compression release mechanism to hold it disengaged while the engine is running.

Figure 17:
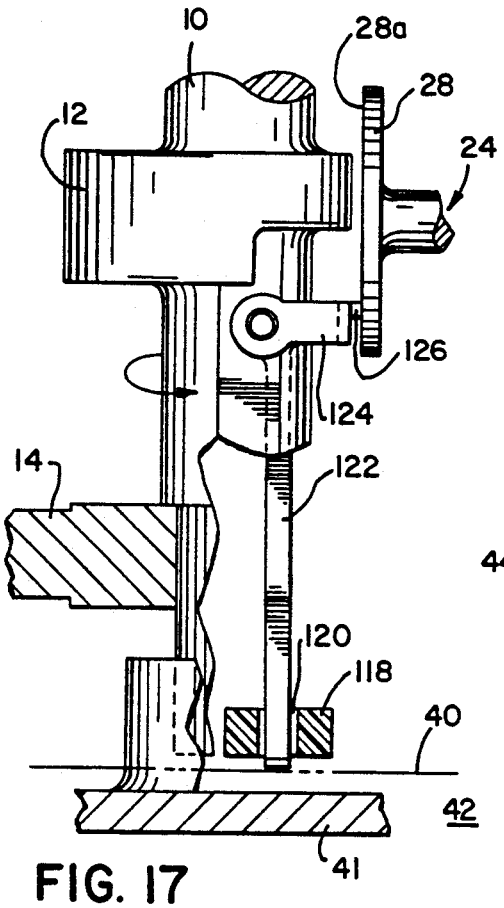
FIG. 17 is a side view of a seventh embodiment having a slidable float, depicted in the engaged position.
Figure 18:
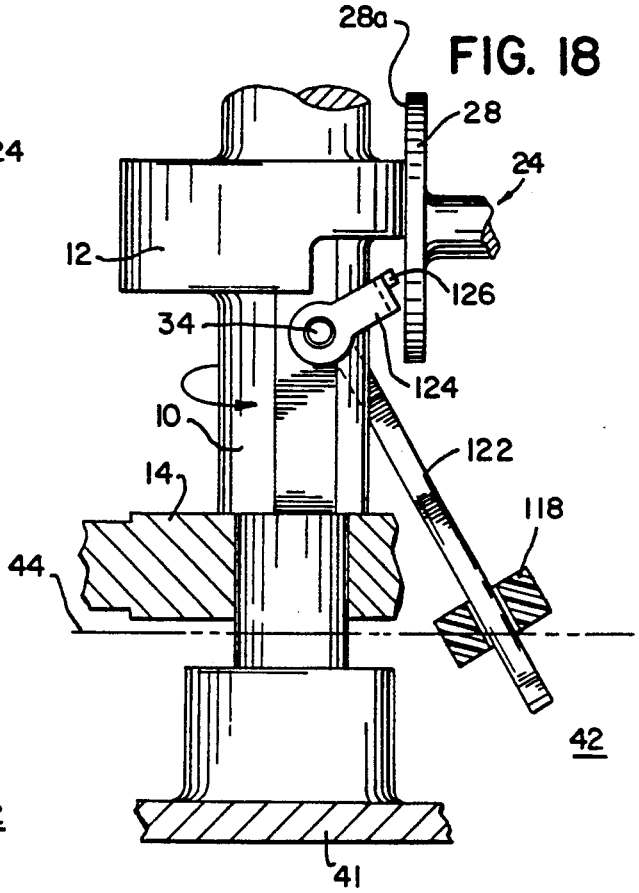
FIG. 18 is a side view of the seventh embodiment, depicted in the disengaged position.

FIGS. 17 and 18 depict an alternate embodiment using a slidable float 118 in place of float 108 (FIGS. 15 and 16). In FIGS. 17 and 18, float 118 has an aperture 120 therein so that float 118 is slidable along lever arm 122, depending upon the level of oil 42. When level 40 of oil 42 is low as depicted in FIG. 17, float 118 is near an end of lever arm 122, causing first compression release member 124 and first cam member 126 to engage tappet surface 28*a*.

When level 44 of oil 42 is adequate as depicted in FIG. 18, float 118 slides upward along lever arm 122 until it reaches the surface of oil 42. Oil resistance on the float causes lever arm 122 to rotate away from cam shaft 10. First compression release member 124 and first cam member 126 pivot about pin 34 to the disengaged position. The slidable float would help create a more consistent resistive force as the float moves across the oil. The positioning of the compression release mechanism would therefore be more consistent throughout the possible range of adequate oil levels. The slidable float could be used in conjunction with a second compression release means to provide more consistent control of positions.

Figure 19:
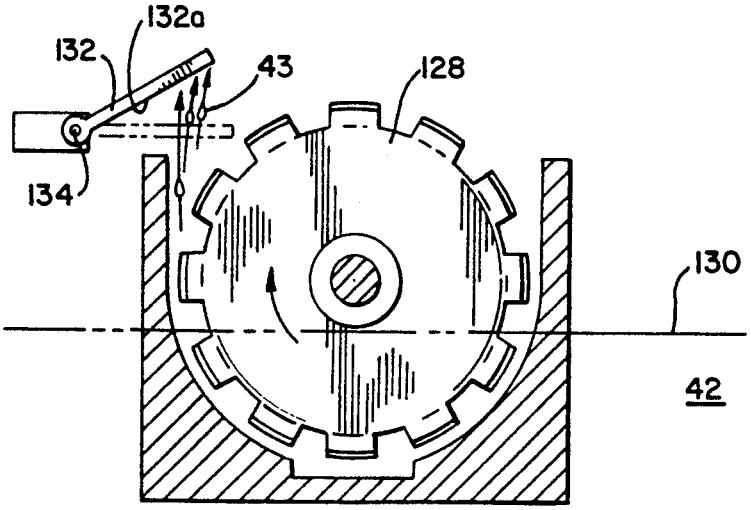
FIG. 19 is a top view of a low oil sensor having an oil slinger and a movable vane.

Up to this point, all of the low oil sensors described herein have used either a paddle or a float in combination with a lever arm interconnected with a pivotable compression release mechanism. However, other types of low oil sensors may be used according to the present invention. FIG. 19 depicts an alternate type of low oil sensor. The alternate low oil sensor depicted in FIG. 19 makes use of the engine's splash system for lubricating internal parts. If the engine employs the splash system of lubrication, it typically will have an oil slinger gear 128 that is partially disposed beneath oil level 130. Slinger gear 128 rotates within oil 42 to pick up and splash lubricating fluid 43. A pivotable oil vane 132 is positioned close enough to slinger gear 128 so that a surface 132*a* of vane 132 is contacted by splashed oil 43. Vane 132 pivots at pivot 134. Vane 132 is interconnected to a first compression release means via a linkage to move the first compression release means to an engaged or disengaged position, depending upon the amount of oil 43 that contacts surface 132*a* of vane 132.

FIGS. 20 through 22A depict a different type of compression release means that may be used with the present invention. The embodiments of the present invention discussed above all used yoke-type compression release mechanisms. The embodiment depicted in FIGS. 20 through 22A uses a D-shaped shaft 136, a centrifugally-responsive flyweight 138, a lever arm 140, and a paddle 141. Shaft 136 is rotatably disposed within an aperture 137 in cam gear 14. Cam gear 14 is affixed to cam shaft 10. The compression release mechanism also includes a return spring 142 and a housing 144 for capturing the return spring, as described in U.S. Pat. No. 5,197,422 issued Mar. 30, 1993 to Oleksy et al, the specification of which is incorporated by reference herein.

FIG. 20 depicts the embodiment at engine starting speeds wherein there is insufficient oil in the crankcase. In FIG. 20, flyweight 138 is located close to cam shaft 10, and lever arm 140 is located in the low oil position, as better shown in FIG. 22. Spring 142 rotates D-shaped shaft 136 so that the rounded portion of shaft 136 engages tappet surface 28*a* to lift the valve off of its valve seat. Compression pressure is thereby substantially reduced in the combustion chamber. Spring 42 is used to return flyweight 138 and shaft 136 to their desired positions before engine starting. Spring 142 is captured between housing 144 and flyweight 138, as depicted and described in the above-referenced U.S. Patent Application Serial Number 07/854,582, filed Mar. 3, 1992. FIG. 22 is a side view that more clearly depicts the compression release mechanism in the low oil position at engine starting speeds.

FIG. 21 depicts the compression release mechanism at engine running speeds when there is an adequate amount of oil in the engine crankcase. In this situation, oil resistance on paddle portion 141 of lever arm 140 causes D-shaped shaft 136 to rotate to the position where the flat side of the shaft is facing tappet surface 28*a* so that tappet 28 is not moved to any significant degree. The compression pressure in the combustion chamber is thus not released. Flyweight 138 has also been moved away from camshaft 10 due to centrifugal force.

Figure 30:
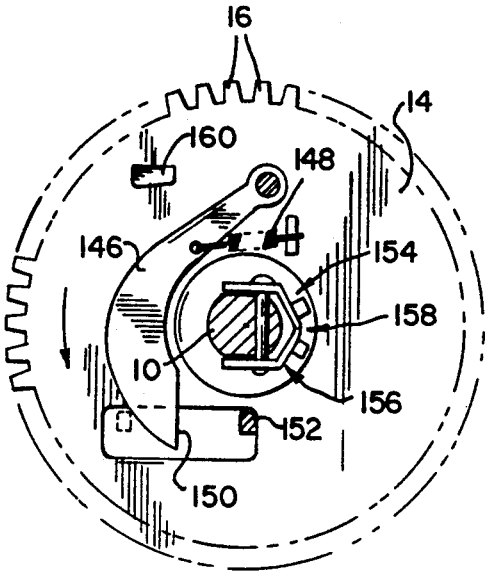
FIGS. 30 through 32 are top views of a retaining means that ray be used with one of the embodiments having first and second compression release members.
Figure 31:
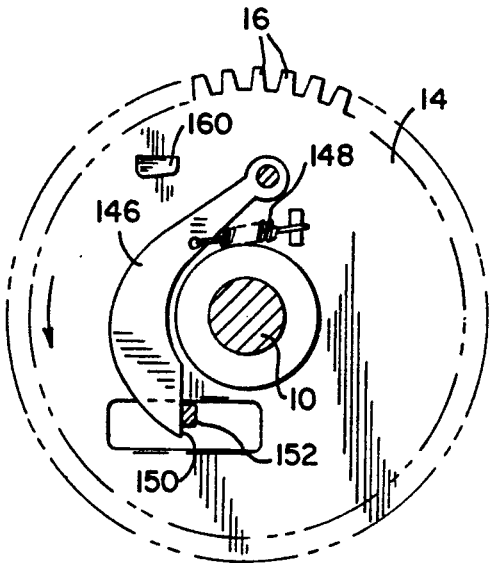
Figure 32:
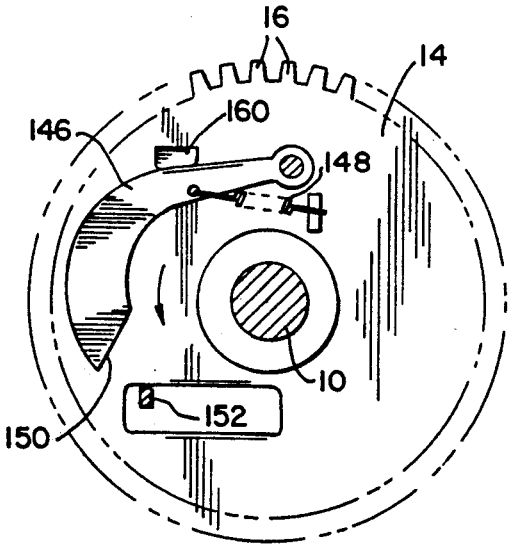

FIGS. 30 through 32 depict a latching mechanism that may be used to retain the low oil sensor in its desired position during engine starting and engine running. The purpose of the latching mechanism is to prevent either the first compression release means, the second compression release means, or both from moving from their desired positions due to centrifugal forces, engine vibration and the like.

The latching mechanism depicted in FIGS. 30 through 32 is preferably used with an embodiment of the present invention that includes both a first compression release means 154 and a second compression release means 156 integrally-formed on a single yoke-type compression release member 158 However, the latching mechanism may be used with other compression release configurations.

In FIGS. 30 through 32, the latching mechanism includes a centrifugally responsive flyweight 146 which tends to move away from cam shaft 10 during rotation of the cam shaft. A spring 148 connected between flyweight 146 and timing gear 14 tends to oppose the centrifugal forces imparted on flyweight 146. Flyweight 146 has a shoulder 150 that provides a positive stop for low oil lever arm 152. Lever arm 152 is free to move away from cam shaft 10 until it abuts shoulder 150. As the engine speed increases, flyweight 146 moves outward, thereby changing the position of shoulder 150

As depicted in FIG. 30, lever arm 152 is substantially parallel to the axis of rotation of cam shaft 10, this rest position also being the low oil level/no start position.

FIG. 31 depicts the latching mechanism in the adequate oil, easy starting position. In FIG. 31, flyweight 146 and its shoulder 150 will allow lever arm 152 to partially move away from cam shaft 10 to an intermediate position, thereby disengaging first compression release means 154 but still retaining second compression release means 156 in its desired starting position. Lever arm 152 and compression release member 158 will be retained in this starting position until the engine speed increases sufficiently so that the centrifugal forces acting on flyweight 146 cause the flyweight to rotate even further radially outward away from cam shaft 10.

FIG. 32 depicts the latching mechanism at engine running speeds wherein flyweight 146 has moved to its radially outermost position until it engages a stop 160. Shoulder 150 also moves radially outward, and lever arm 152 is free to move radially away from cam shaft 10.

When lever arm 152 is in the position depicted in FIG. 32, compression release member 158 is pivoted so that both first compression release means 154 and second compression release means 156 are in the disengaged position. The engine operates without any compression pressure being released in the combustion chamber.

Figure 33:
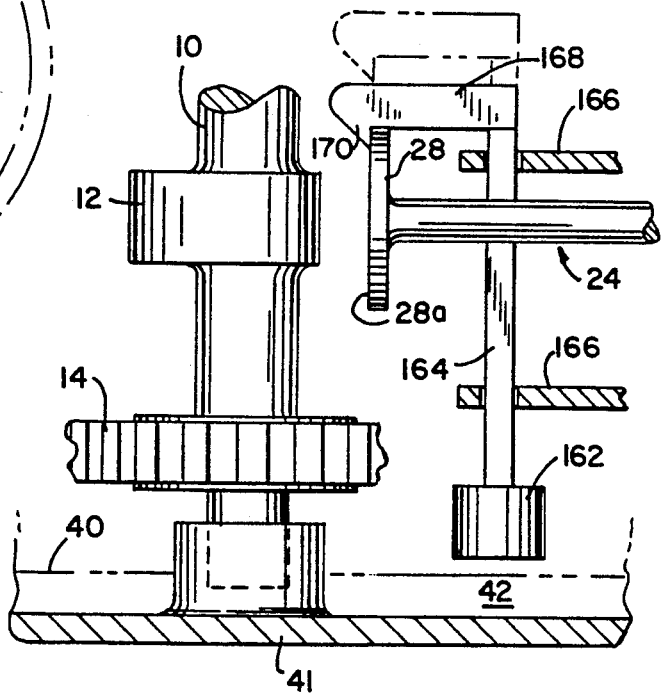
FIG. 33 is a side view of an eleventh embodiment of the present invention.

FIG. 33 depicts an alternate embodiment in which the low oil sensing means and the compression release means according to the present invention are not connected to the cam shaft. In FIG. 33, a float 162 is attached to a first end of an arm 164, the latter being held in position by guides 166. A latch 168, attached to the opposite end of arm 164, has a hook 170 that engages tappet surface **28*a* of tappet 28** when a low oil level is sensed.

When a low oil condition exists, the downward position of float 162 will cause hook 170 to engage tappet surface **28*a*, thereby causing valve operating means 24** to remain open and to substantially release the compression pressure in the combustion chamber.

When the oil level is adequate, float 162, arm 164, and latch 168 will remain in an upward position so that hook 170 is disengaged from tappet surface **28*a***. The valve (not shown) is then operated in the usual manner, allowing the engine to start and to run at normal engine running speeds.

While several preferred embodiments of the present invention have been shown and described, alternate embodiments will be apparent to those skilled in the art and are within the intended scope of the present invention. Therefore, the invention is to be limited only by the following claims.

I claim:

1. An internal combustion engine having a combustion chamber and having a crankcase containing oil, comprising:

low oil sensing means for sensing that the oil in said crankcase is below a predetermined level; and compression release means, interconnected with said low oil sensing means, for releasing the compression pressure in said combustion chamber to limit the power output of said engine when said low oil sensing means senses that the oil in said crankcase is below said predetermined level.

2. The engine of claim 1, further comprising:

valve means for controlling the flow of a gas into or out of said combustion chamber; into or out of said combustion chamber;

valve operating means for operating said valve;

and wherein said compression release means further comprises:

a cam member that engages said valve operating means to substantially open said valve means.

3. The engine of claim 2, further comprising:

a rotatable cam shaft having an outer surface;

at least one pivot pin extending from the outer surface of said cam shaft;

and wherein said compression release means further comprises:

a compression release member that is pivotally connected to said cam shaft by said pivot pin, said cam member being interconnected with said compression release member.

4. The engine of claim 3, wherein said compression release member is interconnected with said low oil sensing means such that said compression release member pivots in response to said low oil sensing means.

5. The engine of claim 3, further comprising:

second compression release means for partially releasing the compression in said combustion chamber to improve engine startability, including:

a second compression release member that is pivotally connected to said cam shaft; and a second cam member, interconnected with said second compression release member, that engages said valve operating means to partially open said valve means at engine starting speeds.

6. The engine of claim 1, wherein said low oil sensing means includes:

a paddle; and a lever arm having a first end interconnected with said compression release means and having a second end interconnected with said paddle.

7. The engine of claim 6, wherein said low oil sensing means further comprises:

a counterweight interconnected with said lever arm.

8. The engine of claim 1, wherein said low oil sensing means includes:

an arm having a first end interconnected with said compression release means; and a float that determines the position of said arm when said oil is below said predetermined level.

9. The engine of claim 1, further comprising:

high oil level sensing means for sensing when said oil is above a second predetermined level to limit the power output of said engine.

10. An internal combustion engine having a combustion chamber and having a crankcase containing oil, comprising:

valve means for controlling the flow of a gas into or out of said combustion chamber;

valve operating means for operating said valve;

low oil sensing means for sensing when the oil in said crankcase is below a predetermined level; and compression release means, interconnected with said low oil sensing means, for engaging said valve operating means to substantially open said valve when said low oil sensing means senses that the oil in said crankcase is below said predetermined level.

11. The engine of claim 10, wherein said low oil sensing means comprises:

a paddle, interconnected with said compression release means, having a surface adapted to contact said oil when said oil level is above said predetermined level.

12. The engine of claim 11, wherein said compression release means is movable to an engaged position in which said compression release member engages said valve operating means when said paddle surface as not substantially in contact with said oil, and wherein said compression release means is movable to a disengaged position in which said compression release member substantially disengages from said valve operating means.

13. The engine of claim 12, further comprising:

retaining means for retaining said compression release means in a selected position.

14. The engine of claim 13, wherein said retaining means includes a centrifugally-responsive flyweight.

15. The engine of claim 10, wherein said low oil sensing means includes:

a member whose position is at least partially determined by the oil level in said crankcase; and a movable arm connected between said member and said compression release means.

16. The engine of claim 15, wherein said member is a paddle.

17. The engine of claim 15, wherein said member is a float.

18. The engine of claim 16, further comprising:

retaining means for retaining said arm in a selected position at engine starting speeds.

19. The engine of claim 18, wherein said retaining means includes a pivotable flyweight that engages said arm.

20. The engine of claim 10, further comprising:

high oil level sensing means for sensing when said oil is above a second predetermined level to limit the power output of said engine.

21. The engine of claim 20, wherein said high oil level sensing means includes a paddle surface adapted to contact said oil when said oil is above said second predetermined level.

22. The engine of claim 10, wherein said low oil sensing means includes:

an arm interconnected to said compression release means; and a float affixed to said arm.

23. The engine of claim 22, wherein said compression release means includes:

a latch that engages said valve operating means when said oil is below said predetermined level to thereby limit the power output of the engine by releasing compression pressure in said combustion chamber.

24. An internal combustion engine having a combustion chamber, a crankcase containing oil, and an oil slinger means for dispersing oil within said crankcase, further comprising:

a low oil supply sensing means for sensing that the oil supplied by the oil slinger is below a predetermined level, said sensing means including a movable vane disposed proximate to said oil slinger means that moves in response to said dispersed oil; and compression release means interconnected with said low oil sensing means for releasing the compression pressure in said combustion chamber to limit the power output of said engine when said oil dispersed is below said predetermined level.

* * * * *

UNITED STATES PATENT AND TRADEMARK OFFICE

CERTIFICATE OF CORRECTION

PATENT NO. : 5,301,643

DATED : April 12, 1994

INVENTOR(S) : Gracyalny

It is certified that error appears in the above-indentified patent and that said Letters Patent is hereby corrected as shown below:

Title page, [75] Inventor: Delete "Garcyalny" and substitute therefor ---Gracyalny---; [56] References Cited: Delete "Papshvili" and substitute therefor ---Papashvili---; CLAIM 2, Col. 12, Line 30, delete second occurrence of "into or out of said combustion chamber;"; CLAIM 12, Col. 13, Line 36, after surface, delete "as" and substitute therefor ---is----.

Signed and Sealed this

Second Day of August, 1994

*Attest:*

Bruce Lehman

BRUCE LEHMAN

*Attesting Officer*

*Commissioner of Patents and Trademarks*